US006199251B1

(12) United States Patent
Zeiler

(10) Patent No.: US 6,199,251 B1
(45) Date of Patent: Mar. 13, 2001

(54) ELASTOMERIC HOOP ATTACHMENT DEVICE

(75) Inventor: Bernhard Zeiler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/495,609

(22) Filed: Feb. 1, 2000

(51) Int. Cl.[7] ..... B23Q 3/06; B68G 7/00
(52) U.S. Cl. ..... 29/33 R; 29/91.5
(58) Field of Search ..... 29/33 R, 713, 29/91, 91.1, 91.7, 91.5, 448, 281.3

(56) References Cited

U.S. PATENT DOCUMENTS 4,385,427 * 5/1983 Fraiser ..... 29/91.5
4,675,962 * 6/1987 Tillner ..... 29/235 X
5,287,610 * 2/1994 Gomolak ..... 29/448 X
5,457,864 * 10/1995 Sakaida ..... 29/281.3 X
5,774,965 * 7/1998 Mintz et al. ..... 29/713 X

FOREIGN PATENT DOCUMENTS

3715276A1 * 11/1988 (DE) ..... 29/33 R

* cited by examiner

*Primary Examiner*—William Briggs
(74) *Attorney, Agent, or Firm*—Terry T. Moyer; Charlotte C. Wilson

(57) ABSTRACT

The present invention relates to a mechanical device that is used to attach polyester elastomeric fabric hoops to a furniture frame in an efficient and production-worthy manner. These elastomeric hoops are used as the back and seat portions of chairs, double occupant seats, and the like. The invention works by overstretching part of an elastomeric fabric hoop and inserting a furniture frame into the overstretched hoop portion. The fabric hoop is then allowed to reduce its size until it is tight around the frame, thereby eliminating the need for additional attachment means. The device is operated by two air-over-oil pneumatic cylinders, two pneumatic cylinders, and a series of electrical read switches. The device requires only compressed air and 110 volts of alternating electrical current to operate.

20 Claims, 9 Drawing Sheets

ELASTOMERIC HOOP ATTACHMENT DEVICE

TECHNICAL FIELD

The present invention relates generally to the field of furniture manufacturing. In particular, the present invention relates to a mechanical device that may be used to attach polyester elastomeric fabric bands or hoops to a furniture frame in a commercially efficient manner. These elastomeric hoops may then be used as the back and seat portions of chairs, double occupant seats, and the like, or may serve as the foundation or supporting structure upon which additional padding or other furniture construction elements may be placed or attached in order to fabricate an upholstered chair or the like.

The invention operates on the principle of stretching a relatively wide belt or hoop, constructed of an elastomeric fabric, and positioning the stretched band or hoop around desired predetermined portions of a furniture frame. When the fabric hoop is allowed to relax (i.e., when the stretching tension is removed), the hoop tightly embraces and engages the frame, thereby becoming functionally attached to the frame without the need for conventional attachment devices such as staples, rivets, nails, etc. The device is operated by two air-over-oil pneumatic cylinders, two pneumatic cylinders, and a series of electrical switches. The device requires only compressed air and 110 volts of alternating electrical current to operate.

BACKGROUND ART

Metal frames have long been used as the structural support for a variety of seating and furniture applications. Such frames are used to anchor some type of fabric, rubber webbing, or other covering material in order to create a support surface to which or upon which other parts of a seat may be attached or otherwise constructed. For instance, foam padding, cushions, and the like are routinely incorporated onto such a support structure.

The method of attaching the support surface material to the furniture frame has been achieved in a variety of ways. Conventionally, the support surface has been attached to the frame using means which are either integrated into the fabric structure or which are external. Such methods include sewn loops or sleeves, tab constructions, laces or other ties, hook and loop attachments (e.g., Velcro™), snaps, zippers, staples, nails, and the like.

U.S. Pat. No. 4,230,365 to Messinger discloses a fabric-covered furniture support frame, in which a fabric sleeve is drawn over a peripheral furniture frame. The fabric sleeve is comprised of a two-way stretch knitted material or a non-stretch, woven material, and the sleeve may be impregnated with a resinous material to add stiffness. The peripheral frame features two side rail members and a plurality of braces connecting the rail members. Unlike the fabric sleeve of Messinger, the fabric hoop utilized in the present invention fits snugly around the furniture frame, with no ends remaining that require additional manipulation. The present invention further provides an automated means for attaching a stretchable fabric to a furniture frame, in the form of a useful and economical device.

Hoops, or cylindrical sleeves, of elastomeric fabrics have also been used and are conventionally applied by stretching the entire fabric hoop with a mechanical means and then inserting the furniture frame into the open, outstretched hoop. The stretching tension on the hoop is then removed and the hoop is allowed to reduce its size until, in its partially relaxed state, it is tight on the frame. Such a process is traditionally used for hoops made from rubber webbing because this type of webbing can be significantly over-stretched, up to about 300% (i.e., about three times) of its normal, relaxed circumference. The stretch of the webbing when attached to the frame is about 200% (i.e., about twice) of its normal circumference. Such stretch is acceptable in rubber webbing, but is very difficult to achieve with polyester elastomeric fabrics because of the relatively limited stretch characteristics of these fabrics.

For purposes of discussion herein, it is helpful to define the following terms. "Elastomeric fabrics" are fabrics made of woven or knitted yarns of various synthetic polymers; such yarns, and the fabrics constructed from such yarns, exhibit some properties that are similar to those of natural rubber, such as high stretchability and recovery. "Elastomeric recovery" is the degree to which an elastomeric fabric returns to its original size and shape after being placed under tension and deformed. The term "hoop" refers to a cylindrical sleeve or loop of fabric, which may be created by, for example, joining the opposite ends of a rectangular piece of elastomeric fabric in a manner that will maintain the integrity of the loop when the loop is placed under tension. Such methods include stitching, bonding, or other suitable seaming means. Alternatively, the hoop may be in the form of fabric that has been formed as a continuous loop of fabric, with no need for seaming or joining.

When referring to the stretch exhibited by the fabric hoops, several terms will be used as defined herein. The term "relaxed" refers to a fabric in an unstretched condition (that is, having no applied tension). The term "over-stretch" refers to the stretch exerted on the fabric as it is being applied to the furniture frame. The term "prestretch" refers to the degree of stretch of a fabric once the fabric hoop is positioned on the furniture frame. The term "load stretch" refers to the degree of stretch experienced by the fabric as it bears a weight in the course of functioning as a seating device, such as that exerted by a seat occupant. The term "total stretch" refers to the sum of the prestretch and the load stretch. The "maximum stretch" of a polyester elastomeric fabric is the stretch beyond which the fabric loses its elastomeric recovery, which, for elastomeric fabrics made of the preferred polyester material, is generally being in the range of 25% to 30% of the original, untensioned dimension of the fabric. The total stretch of the fabric should not exceed the maximum stretch of the fabric.

Because polyester elastomeric fabrics are capable of achieving a maximum stretch of only about 25% or 30% of their original, untensioned dimension (which dimension shall be referred to as length, as in circumferential length), certain adjustments must be made in stretching these fabrics for attachment to a furniture frame. If the fabric is stretched beyond the maximum stretch, then it is likely to lose its elastomeric recovery. In seating applications, loss of elastomeric recovery adversely affects the comfort of the seat occupants and the durability of the seat during repeated use.

A problem encountered in the manufacture of seating using rubber webbing is that the majority of rubber webbing tends to stick to the frame during application, making such webs relatively difficult to position or re-position on the frame. On the other hand, the polyester elastomeric fabrics utilized in the present invention do not have the same tendency as the rubber web to stick to the frame. Rather, these fabrics, when used in hoops that are in a stretched configuration, tend to slide easily onto the frame and into position, requiring a lower degree of over-stretch than their rubber counterparts and making them more easily utilized in this type of application. When properly positioned and relaxed, hoops of these materials provide a firm and relatively immobile grip, and remain fixed in position on the frame during use, yet may be readily adjusted or removed as required. Thus, the present invention is able to accommodate the characteristic of polyester's limited stretch (as compared with rubber) and, at the same time, utilize, to commercial advantage, the relatively low sliding friction between the tensioned fabric and the metal frame.

In addition to the ease of use during manufacturing (e.g., from relatively low sliding friction between the fabric and the frame), several other advantages are realized by using polyester elastomers instead of rubber webbing. It has been found that, over time, the polyester elastomeric fabric does not tend to deteriorate as quickly as the rubber webbing. Furthermore, the elastomeric fabrics are suitable for applications in which such fabrics can act as both the support surface and the face fabric (i.e., with no additional surface fabric being attached). Another significant consideration, in this regard, is the increased comfort of the occupant when seated in a chair whose support surface is made from elastomeric fabrics as compared to the chair whose support surface is made from rubber webbing that, in turn, is covered with padding, face fabrics, or the like. This added comfort is believed to be due to the superior ability of such fabrics to distribute weight and to allow for the circulation of air around and through the support surface. Thus, durability, comfort, and the possible elimination of face fabrics are advantages over the seating support surfaces of the prior art.

The device disclosed herein is capable of realizing the above-described benefits. In particular, the device disclosed herein is capable of achieving, in polyester elastomeric fabric, a desired level of stretch and is capable of attaching such fabric to a metal furniture frame by tension alone, with no other attachment means being required. For these reasons, the present invention represents a useful advancement over the prior art.

SUMMARY

The device disclosed herein attaches a fabric hoop to a metal furniture frame. The device has means for stretching a portion of the elastomeric fabric hoop and then positioning the entire fabric hoop over the furniture frame. The device has both pneumatic and electrically driven parts, and requires only compressed air and 110 volts of alternating electrical current to operate. The device of the present invention is particularly well suited for applications involving polyester elastomeric fabrics, which have a well-defined and limited level of stretch, and which have a low coefficient of sliding friction on the kinds of metal surfaces used in the fabrication of furniture (e.g., steel or aluminum).

Therefore, it is an object of this invention to produce a device that is capable of attaching an elastomeric fabric to a furniture frame, thereby creating a support structure for a variety of seating and other furniture applications.

It is another object of this invention to provide a device that is capable of over-stretching a portion of an elastomeric fabric hoop to a desired stretch, maintaining the desired stretch until such time as a furniture frame is inserted into the over-stretched portion of the fabric hoop, and allowing the furniture frame to be pushed through most of the remainder of the fabric hoop as such tension is released.

It is a further object of the invention to provide a means for controlling the stretch of the elastomeric fabric such that the maximum stretch of the fabric is not exceeded at any point.

It is yet another object of the invention to provide a simple, economical, and efficient means of attaching polyester elastomeric hoops to a furniture frame, in such a way that no additional securing means are required and in such a way that the fabric hoop can be removed from the frame if necessary.

Other objects and advantages of the present invention will become apparent from the detailed description and the following drawings, in which:

DETAILED DESCRIPTION

Figure 1:
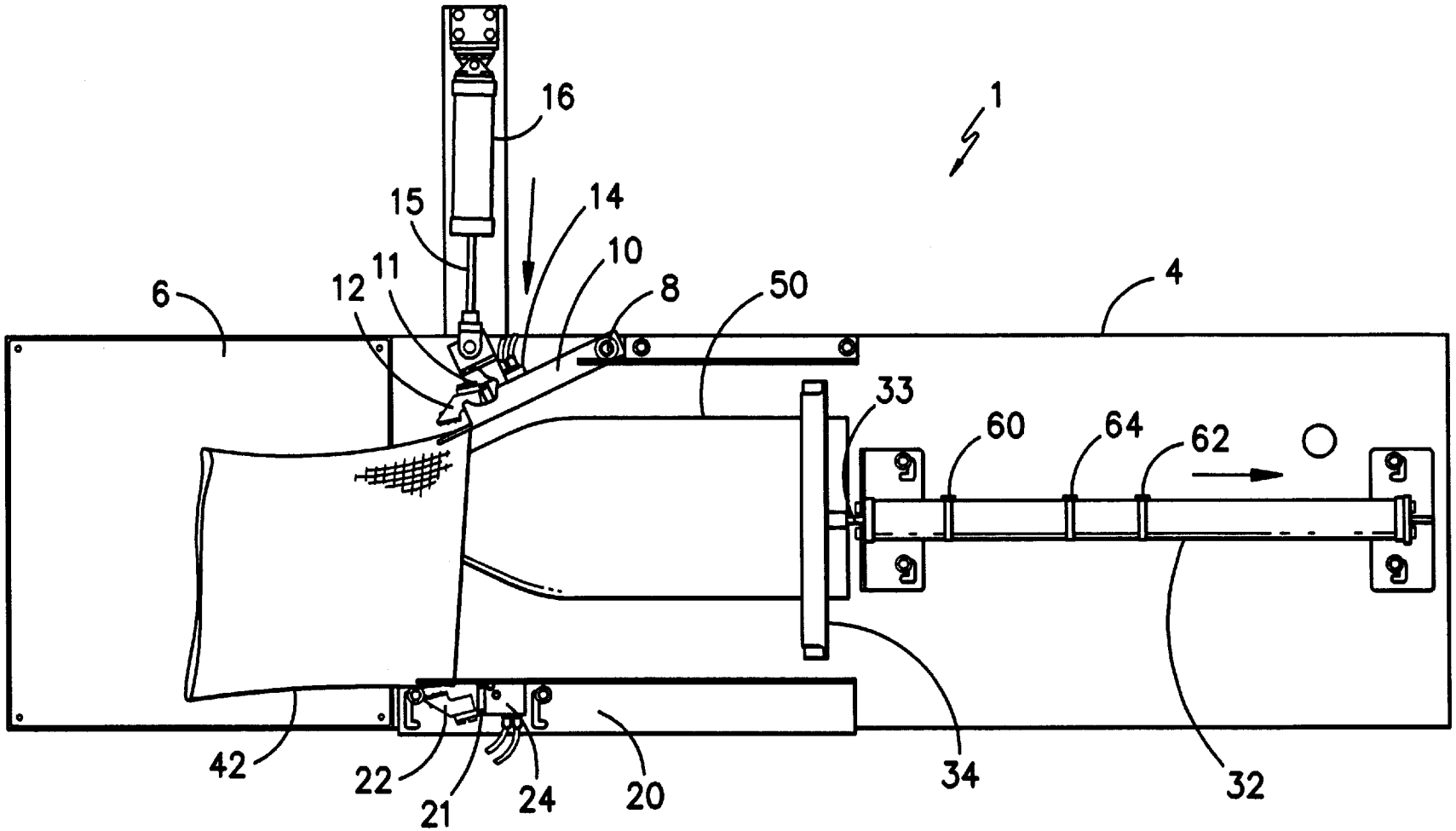
FIG. 1 is an overhead view of the device of the present invention, in which the fabric hoop is clamped to a set of stretch arms.
Figure 2:
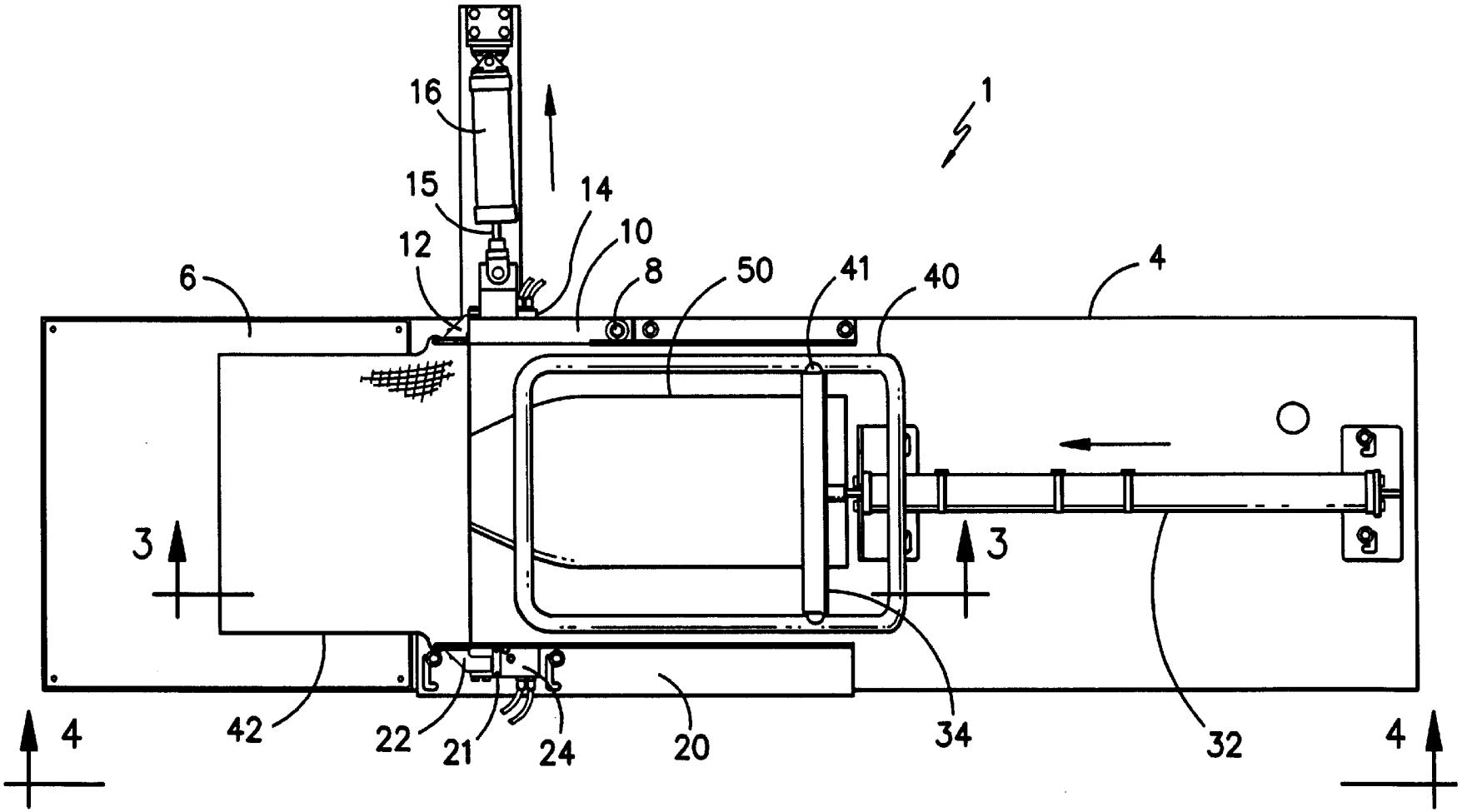
FIG. 2 is an overhead view of the device of FIG. 1, in which the clamped portion of the fabric hoop has been over-stretched by the stretch arms, and in which a furniture frame has been inserted into a frame carrier adapted for such purpose.

Turning now to the drawings, FIGS. 1 and 2 show device 1, which includes a base 4, on which the stretching operations and assembly take place, and an adjacent table 6 having an adjustable height. Device 1 uses a movable stretch arm 10 and a fixed stretch arm 20 to open a fabric hoop 42, while clamps 12, 22 hold fabric hoop 42 on stretch arms 10, 20; and push cylinder 32 pushes furniture frame 40 into hoop 42. The movement of stretch arm 10 is controlled by a stretch cylinder 16, and clamps 12, 22 are controlled by clamp cylinders 14, 24. The operations of device 1 will be discussed in detail below.

In the "home" position, the components of device I are located in certain positions, as shown in FIG. 1 and described as follows. Rod 33 of push cylinder 32 is in a retracted position. Rod 15 of stretch cylinder 16 is in an extended position, which allows stretch arm 10 to be in its most extended position. Clamp cylinders 14, 24 are in a disengaged position, indicating that clamps 12, 22 are open. In this configuration, these components are capable of receiving fabric hoop 42 and furniture frame 40. The movement of these components (i.e., stretch cylinder 16, push cylinder 32, and clamp cylinders 14, 24) are controlled by a control panel 18 (see FIGS. 4 and 10), which operates on a basic logic sequence that will be discussed herein. Fabric hoop 42, which is initially in a relaxed condition, is attached to stretch arms 10, 20.

The preferred air pressure for clamping cylinders 12, 22 should be in the range of 1 to 250 pounds per square inch (gauge), more preferably greater than about 80 p.s.i.g., and most preferably greater than about 90 p.s.i.g. The preferred pressure on push cylinder 32 should be greater than about 70 p.s.i.g. The preferred pressure on stretch cylinder 16 should be greater than about 50 p.s.i.g. It is understood that if the cross-sectional area of any cylinder is increased, then a lower air pressure for that cylinder could be utilized with the same result. It is further understood that if hydraulic components are utilized, then significantly higher pressures may be realized (up to, say, 5000 p.s.i.g.). The maximum pressure is controlled by a pressure regulator (not shown) inside control box 18.

As depicted in FIG. 1, push cylinder 32 has three reed switches (60, 62, 64) operably associated with the shaft thereof. As rod 33 of push cylinder 32 is extended, each of switches 60, 62, 64 trigger certain actions within device 1. Reed switch 60 is positioned toward the end of push cylinder 32 that is nearest frame carrier 34. Reed switch 62 is positioned toward the end of push cylinder 32 that is furthest from frame carrier 34. Reed switch 64 is positioned approximately midway between reed switches 60 and 62, somewhat closer to switch 62.

Figure 6:
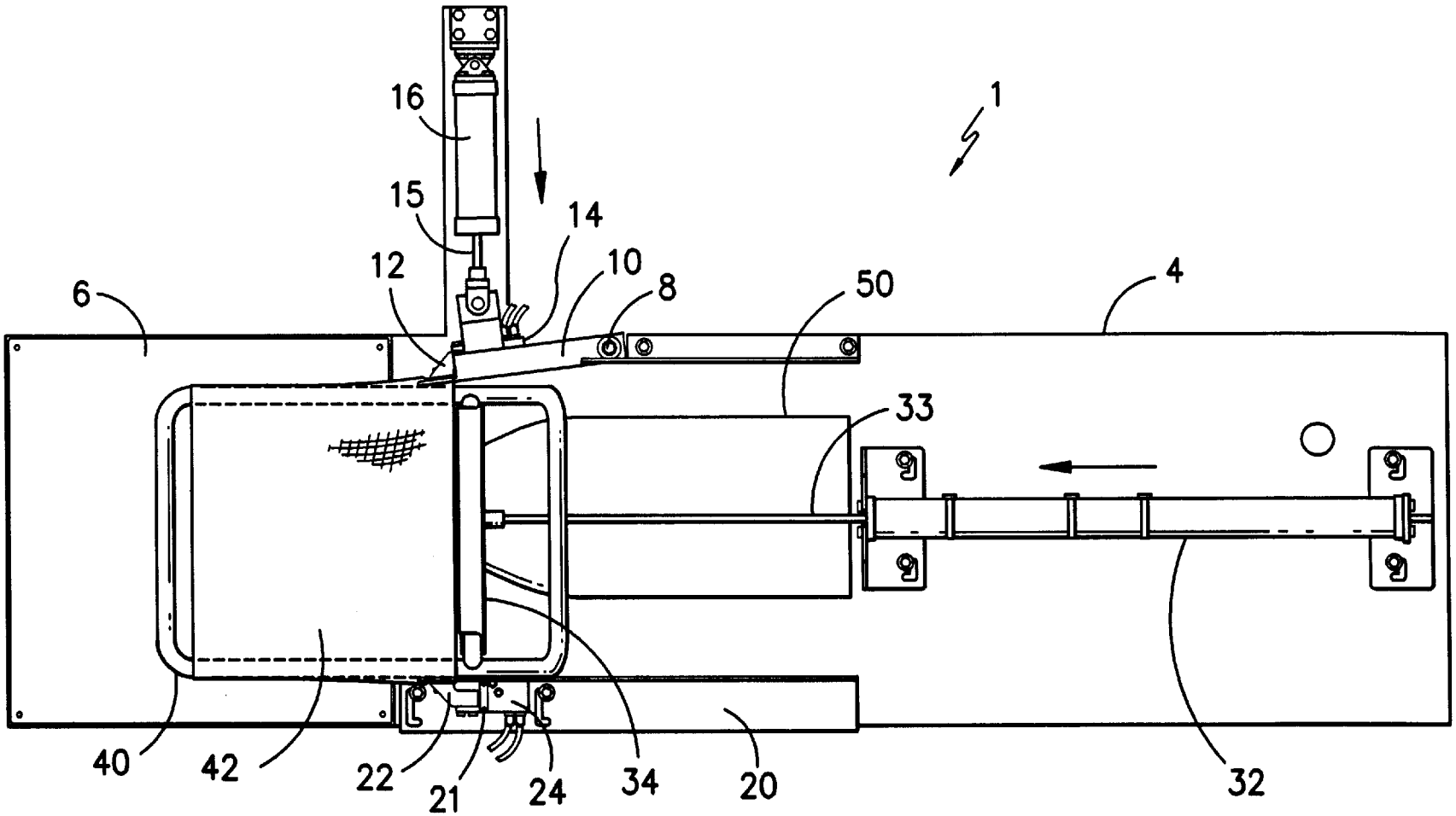
FIG. 6 is an overhead view of the device of FIG. 1, in which the furniture frame has been pushed completely through the fabric hoop.

For purposes of simplification, it shall be understood that the portion of rod 33 opposite that of frame carrier 34 is connected to a magnetic piston (not shown) that activates reed switches 60, 62, 64 and that is acted on by air and oil under pressure. In operation, the piston associated with rod 33 passes reed switch 62, as rod 33 of push cylinder 32 extends (i.e., as frame 40 is pushed into fabric hoop 42). As the piston associated with rod 33 passes reed switch 64, the pressure on stretch cylinder 16 is reduced to about 10 p.s.i.g. (as shown in FIG. 6), thereby causing the tension on fabric hoop 42 to be reduced. This reduction in tension facilitates the removal of fabric hoop 42 from stretch arms 10, 20. When the piston associated with rod 33 passes reed switch 60, clamps 12, 22 open and fabric hoop 42 is released from stretch arms 10, 20 into its desired position on frame 40. Reed switch 60 is not located at the end of push cylinder 32, but a small distance from it; as rod 33 continues to its maximum extension from cylinder 32, it pushes the assembled, fabric-covered frame off of stretch arms 10, 20 and onto table 6.

In a preferred embodiment, fabric hoop 42 is comprised of a polyester elastomeric fabric, characterized by a maximum stretch of about 25% of the original width of the fabric or circumference of hoop 42. Particular examples of suitable polyester elastomeric fabrics include those disclosed in U.S. Pat. No. 5,807,794 to Knox et al., U.S. Pat. No. 5,632,526 to McLarty et al., U.S. Pat. No. 5,533,789 to McLarty et al., and U.S. Pat. No. 5,596,888 to McLarty et al. (all commonly assigned). A preferred example of this type of fabric includes the elastomeric fabric sold under the tradename Crystalflex III (available from Milliken & Company, Spartanburg, S.C.). Woven constructions having similar stretch characteristics may also be utilized. Alternatively, fabric hoop 42 can be comprised of a circular knit fabric, in which hoop 42 is created when the fabric is knitted. Fabric hoop 42 can be used as the support surface for furniture frame 40, or can be used as the primary surface of the furniture structure. Additionally, fabric hoop 42 can be tapered or otherwise contoured to better match the shape of frame 40.

Fabric hoop 42 can be created in a variety of ways. Fabric hoop 42 can be constructed as a tube of fabric (open on both ends) or as a sock of fabric (open on only one end). The sock of fabric can be generated, either by sealing the end of a tube of fabric, or by sealing along three of the four coincident cut edges of two congruent panels of fabric, or by sealing along two of the three coincident cut edges of a folded panel of fabric. The edges of the panels do not have to be straight, as the panel shape can conform to the shape of frame 40 (as may include curved edges). Fabric hoop 42 is preferably created by bringing together the opposing end portions of a panel of the desired fabric, thereby forming a loop, and generating a flat, interlocking seam that joins those end portions together. Alternatives to sewing a flat seam include attachment by zippers, hook and loop attachments, snaps, hooks, rivets, screws, welding, gluing, and the like. Whatever joining means are used to produce fabric hoop 42, it is important that such joining result in a relatively unobtrusive seam so as to minimize discomfort to seat occupants in the event the seam is in contact with the seat occupant (as opposed to being positioned away from the occupant, e.g., facing the wall or the floor). In most cases, such as the preferred embodiment having a flat, interlocking seam, the joining means is placed in the center lower portion of the seat portion of frame 40.

Where using a sock configuration instead of a hoop, it may be desirable to close the remaining coincident edge after application to the frame by wrapping it around bar 41. Such an application may require a second bar located above and parallel to bar 41 to allow the back of the seat to be attached in a similar manner. Hoop 42 can have integrated attachment means as described above on the remaining coincident edge for attaching hoop 42 to center bar 41 or to itself, having been first wrapped around bar 41.

As shown in FIG. 2, a metal furniture frame 40 is positioned inside C-shaped frame carrier 34, which is permanently attached to rod 33 of push cylinder 32. Furniture frame 40 typically has center bar 41 that is held by frame carrier 34. Stretch cylinder 16 pulls movable stretch arm 10 away from fixed stretch arm 20 and results in the localized over-stretching of the clamped portion of hoop 42, thereby creating an opening into which frame 40 may be easily inserted. Hoop 42 is clamped to stretching arms 10, 20. The clamping mechanism will be discussed in greater detail herein.

Figure 3:
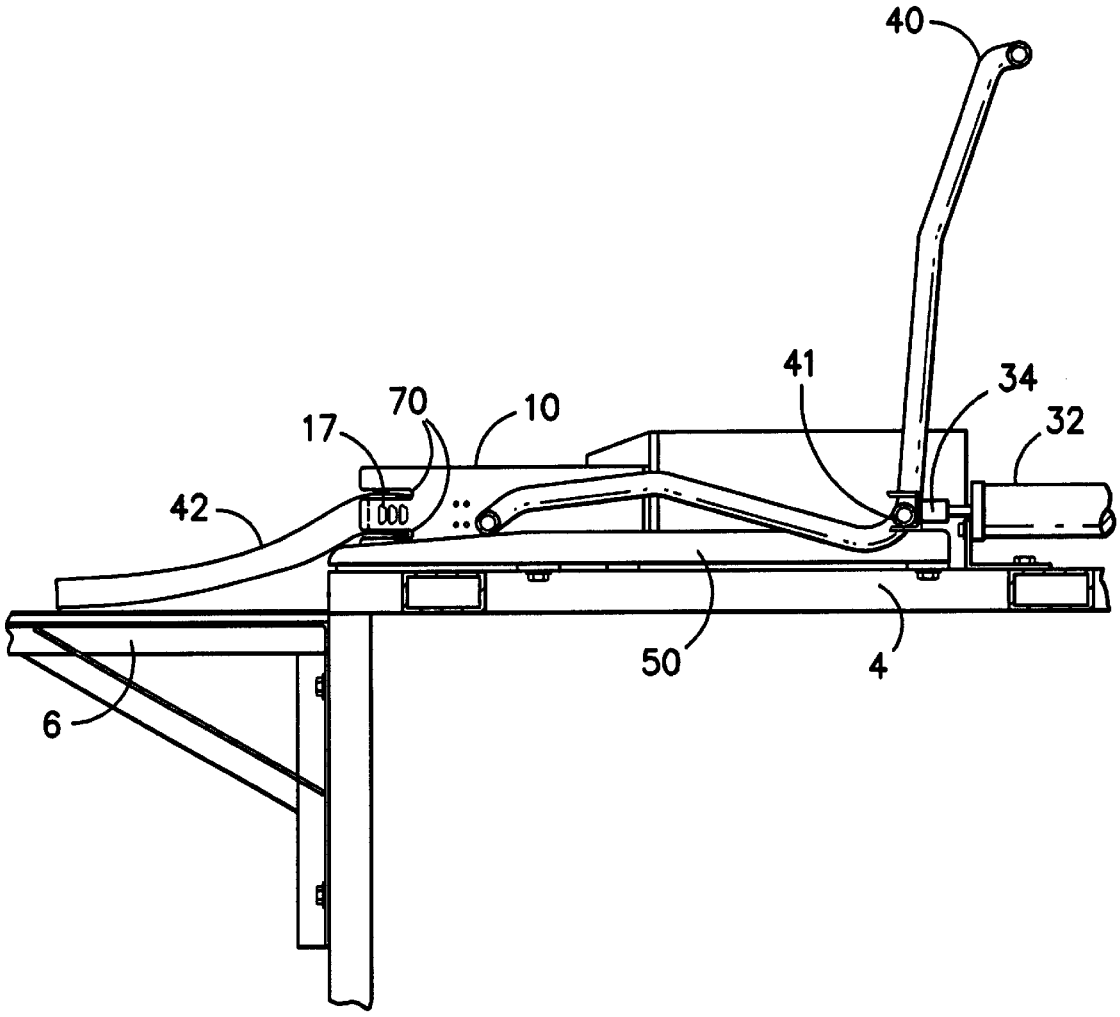
FIG. 3 is a sectional view taken along Line 3—3 of FIG. 2.

FIG. 3 is a cross-sectional view of device 1. In the center portion of base 4 is bullet-shaped guide 50 attached to base 4. Guide 50, which is made of a durable material having rounded edges that is shaped in the form of a non-equilateral pentagon, is substantially flat and is used to direct the movement of metal frame 40 into fabric hoop 42. The material may be comprised of a plastic or fiberglass, or, for example, guide 50 may be fashioned from a portion of a two-by-twelve piece of lumber that has had the upper edge portions rounded for safety purposes in the area between stretch arms 10, 20. By rounding the edge portions of guide 50, a potential pinch point is eliminated, thus increasing the level of safety for operators of device 1. Any other durable material that met the dimensional and functional requirements described herein would be suitable.

Figure 4:
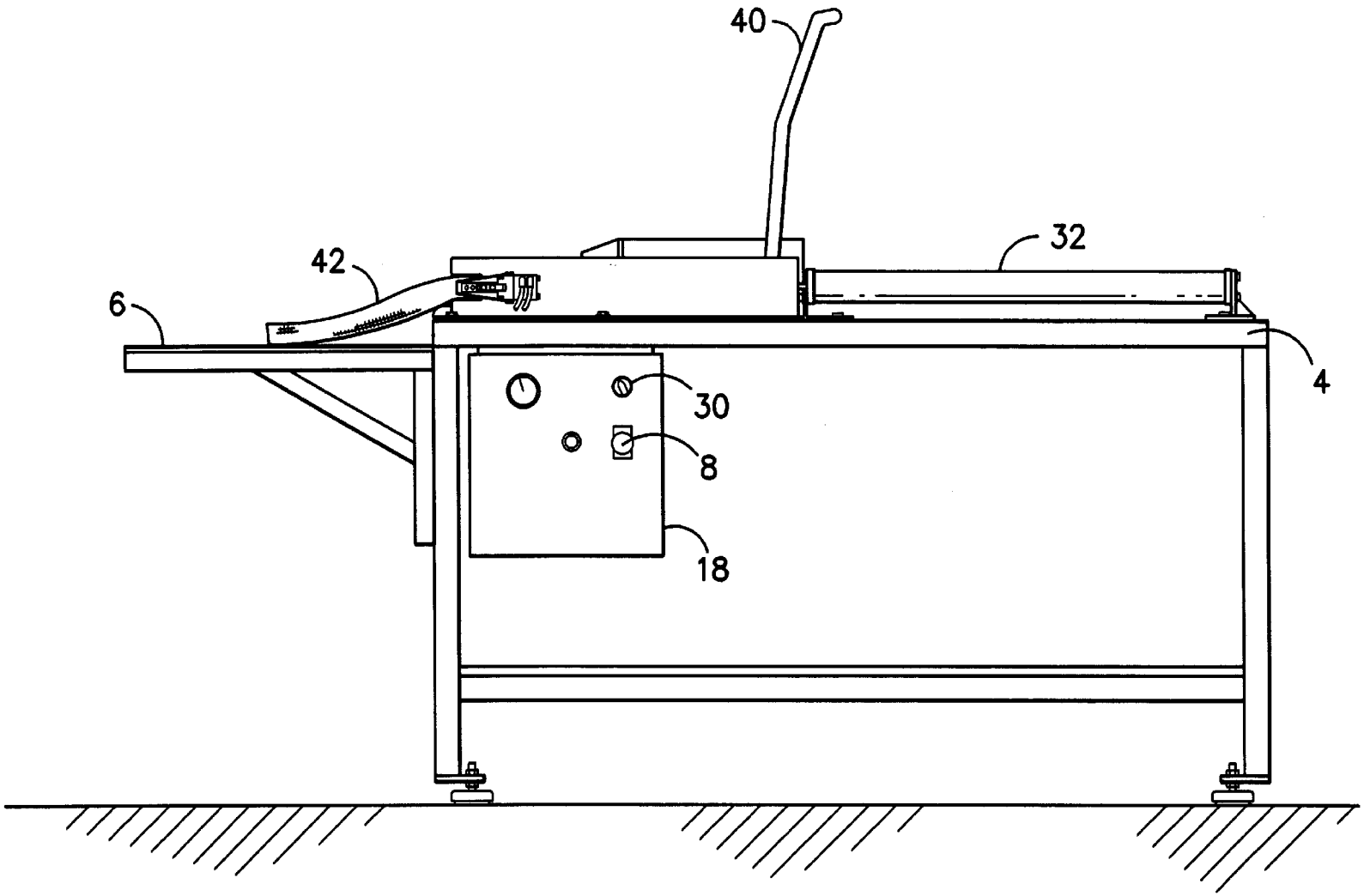
FIG. 4 is a side view, taken along Line 4—4 of FIG. 2, showing the position of the furniture frame in respect to the base and the table and further showing the position of the control box.

FIG. 4 is also a side view, in which the relative position of control panel 18 is shown. Control panel 18 has an operational switch 8 which controls the movement of clamps 12, 22 and stretch cylinder 16. Fabric hoop 42 is attached to stretch arms 10, 20 so that fabric hoop 42 touches the stops 70 on each arm 10, 20. When operational switch 8 is depressed, clamp cylinders 14, 24 cause clamps 12, 22 to close; simultaneously, stretch cylinder 16 retracts and laterally stretches the clamped portion of fabric hoop 42 in a way that will allow fabric hoop 42 to accommodate the intrusion of frame 40 as it is advanced by push cylinder 32. Frame 40 is inserted into frame carrier 34, which is attached to the rod of push cylinder 32. Control panel 18 also has a two-position rotary switch 30, which controls the movement of push cylinder 32. When rotary switch 30 is turned to the counterclockwise position (as shown in FIG. 4), it initiates the movement of push cylinder 32 that pushes frame 40 into fabric hoop 42. Following the successful attachment of fabric hoop 42 to frame 40, rotary switch 30 turned clockwise to the "home" position, retracting rod 33 of push cylinder 32. The action of rod 33 passing reed switch 62, via conventional electromechanical logic means, serves to actuate and extend rod 15 of stretch cylinder 16 and to reset operational switch 8, in preparation for receiving the next fabric hoop 42.

Figure 5:
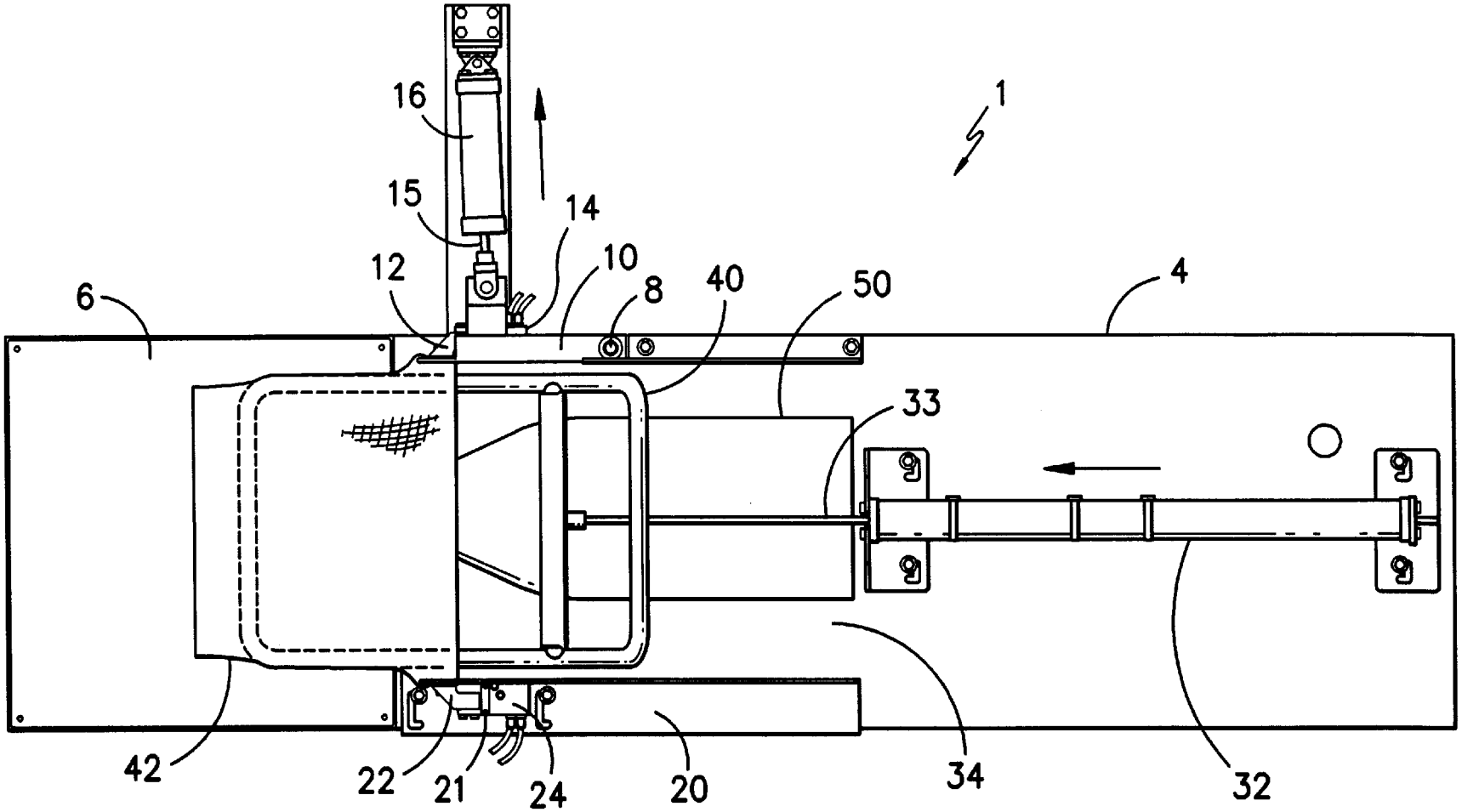
FIG. 5 is an overhead view of the device of FIG. 1, in which the clamped portion of the fabric hoop has been over-stretched and in which the furniture frame has been partially pushed into this over-stretched portion of the fabric hoop.

FIG. 5 depicts the next sequence of operations, in which frame 40 is pushed (in frame carrier 34 and by push cylinder 32) into the over-stretched portion of hoop 42. The clamped portion of hoop 42, which is typically only the first two or three inches of hoop 42, is over-stretched and opened, so that frame 40 enters this clamped portion with very little resistance. The portion of hoop 42 in the over-stretched area is subjected to a stretch of between about 12% and about 22%, and preferably between about 15% and about 20%. In any case, hoop 42 should be subjected to a stretch that is less than the maximum stretch (say, 25% to 30%) of the preferred elastomeric fabric comprising hoop 42.

FIG. 6 shows device 1, as frame 40 is pushed completely through to the end portion of hoop 42. At this point, several automatic actions facilitate the release of hoop 42 from stretch arms 10, 20. The pressure on stretching cylinder 16 is released, thereby allowing the tension in hoop 42 to pull movable stretch arm 10 against frame 40, thus minimizing the fabric's over-stretch and reducing the friction force between fabric hoop 42 and stretch arms 10, 20. Next, fabric clamps 12, 22, which may be of conventional design and operation, so long as hoop 42 is securely held as necessary, automatically release hoop 42 from stretch arms 10, 20.

Figure 7:
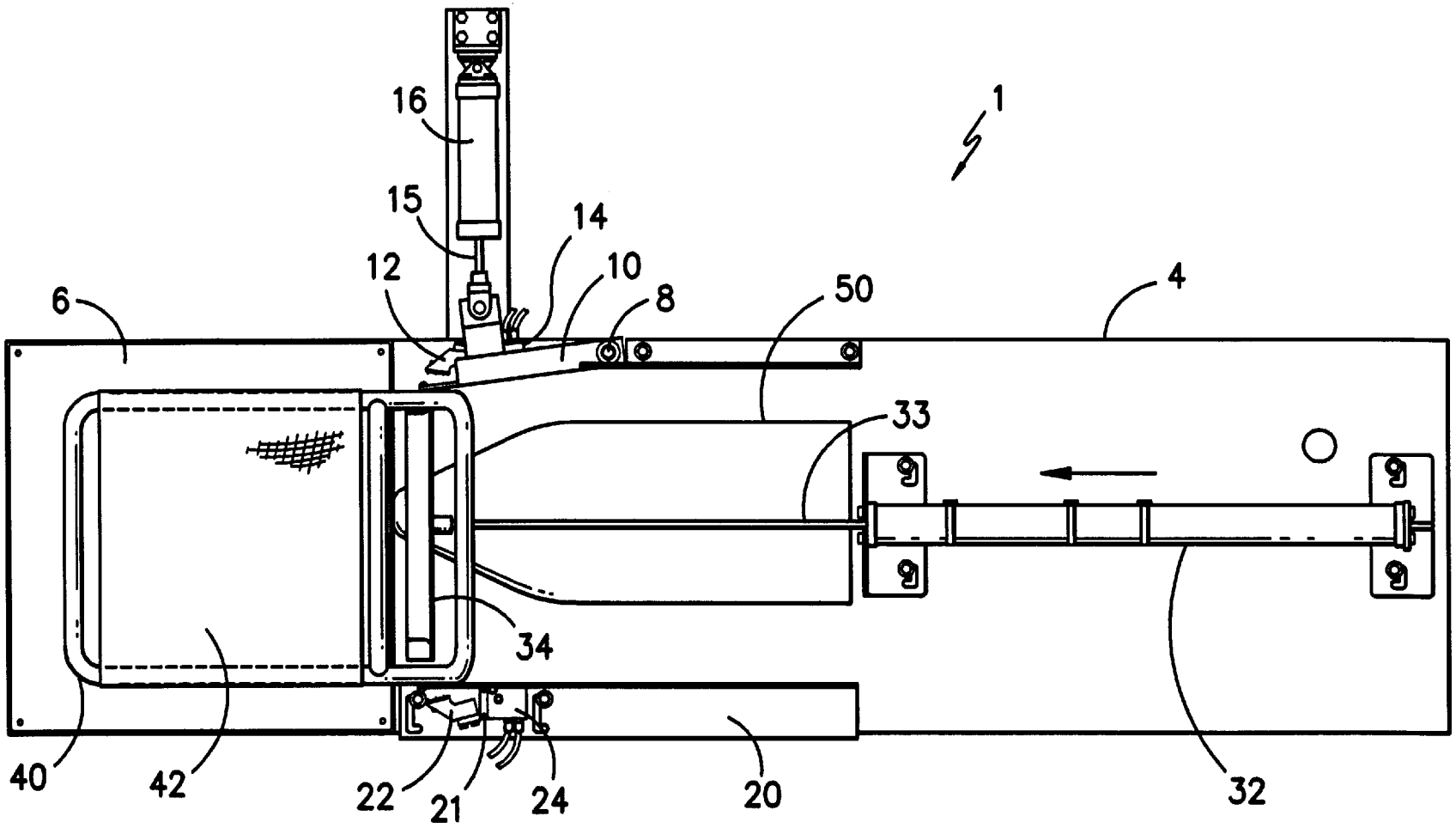
FIG. 7 is an overhead view of the device of FIG. 1, in which the fabric hoop has been successfully attached to the furniture frame and released from the clamps, and the covered frame has been pushed from the frame carrier onto the table.

Finally, as shown in FIG. 7, push cylinder 32 continues to move frame 40, which is now fully inserted into fabric hoop 42, thereby pulling fabric hoop 42 off stretch arms 10, 20. Frame 40 drops automatically off carrier 34 and onto table 6. Table 6 is typically at a lower elevation to accommodate frame designs that feature bends, but can be adjusted to accommodate other frame designs. The prestretch exhibited by fabric hoop 42 as attached to frame 40 is usually between about 1% and about 20%, more preferably between about 2% and about 12%, and most preferably between about 3% and about 7%.

Figure 8:
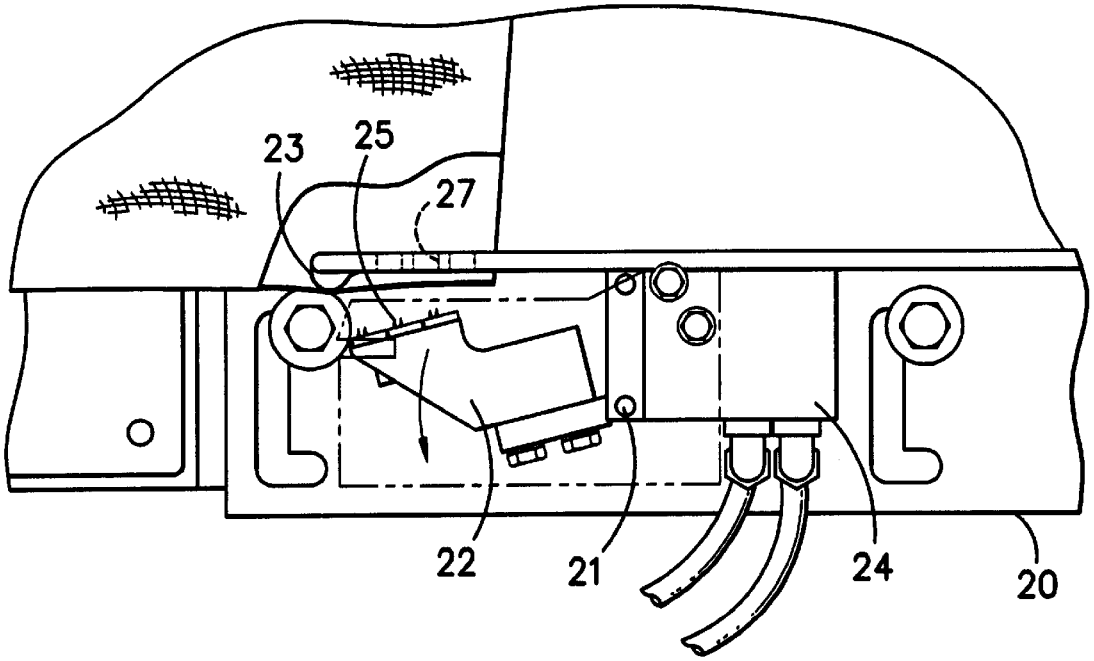
FIG. 8 is a side view of the clamping mechanism of the fixed stretch arm, in which the clamping mechanism has moved into a disengaged (open) position.
Figure 9:
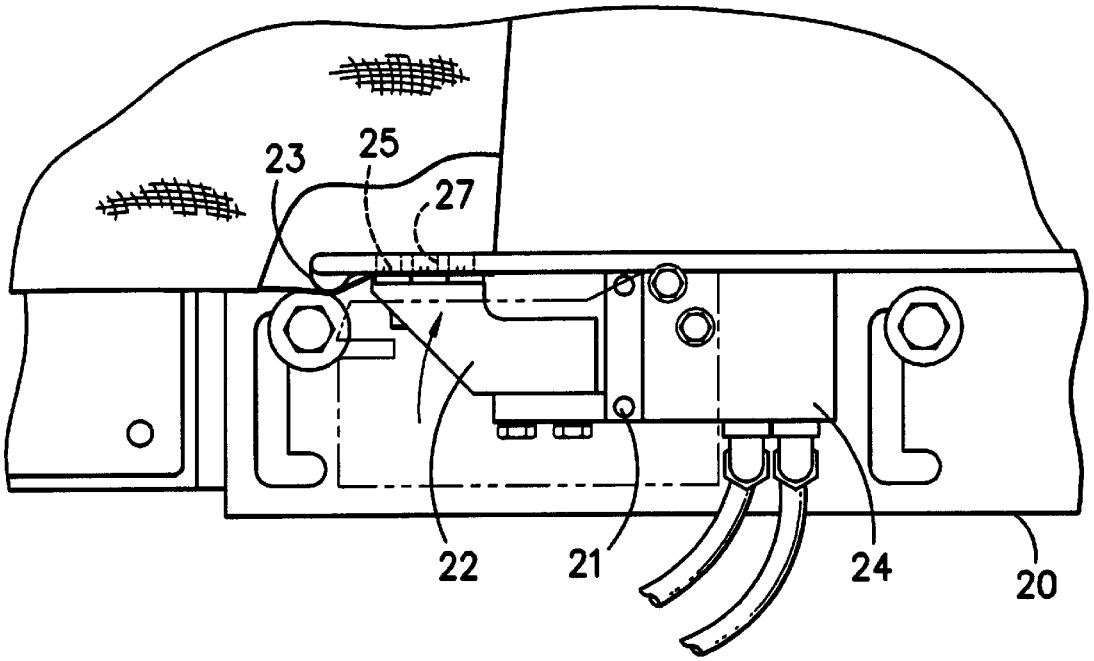
FIG. 9 is a side view of the clamping mechanism of FIG. 8, in which the clamping mechanism has moved into an engaged (closed) position.

Fabric hoop 42 must be securely held in position on stretch arms 10, 20, but must be quickly released when frame 40 has been pushed through hoop 42 and into position on frame 40. This function is provided by the clamping mechanism shown in detail in FIGS. 8 and 9. It should be noted that although FIGS. 8 and 9 represent clamp 22 that is associated with fixed stretch arm 20, the working of clamp 12 that is associated with stretch arm 10 is substantially similar. Clamps 12, 22, which have a plurality of individual pins 15, 25, practically attached thereto by way of one or more pin plates, are actuated by pneumatic, clamp cylinders 14, 24. Pins 15, 25 penetrate hoop 42 and prevent hoop 42 from sliding. Bulge 13, 23 at the end portions of stretch arms 10, 20 assist in preventing hoop 42 from sliding.

The required clamping action is achieved through the insertion of pins 15, 25 (located on each clamping arm) into corresponding pin slots 17, 27. Particularly well suited for this application are medium-tempered, steel pins having a diameter of about $1/16^{th}$ of an inch. The individual pins 15, 25 are positioned in pin plates at an angle that is not perpendicular to the surface of the pin plate. Specifically, pin incline angles of between 5 and 15 degrees off perpendicular in the direction of clamp cylinder 14, 24, and preferably pin angles of about 10 degrees in the same direction, have been found to be particularly effective to both secure fabric hoop 42 and to eventually aid in the release of fabric hoop 42 from stretch arms 10, 20.

As mentioned above, certain features of device 1 aid in the release of fabric hoop 42 from the clamping mechanisms on stretch arms 10, 20. In addition to the angular placement of individual pins 15, 25 in the pin plates, the clamping mechanisms of clamps 12, 22 each pivot around a central point 11, 21. As the clamping mechanism pivots, individual pins 15, 25 are pulled from the clamped portion of fabric hoop 42. The quick removal of pins 15, 25 from fabric hoop 42 helps to prevent tears in fabric hoop 42 and also helps to prevent bending of individual pins 15, 25.

Figure 10:
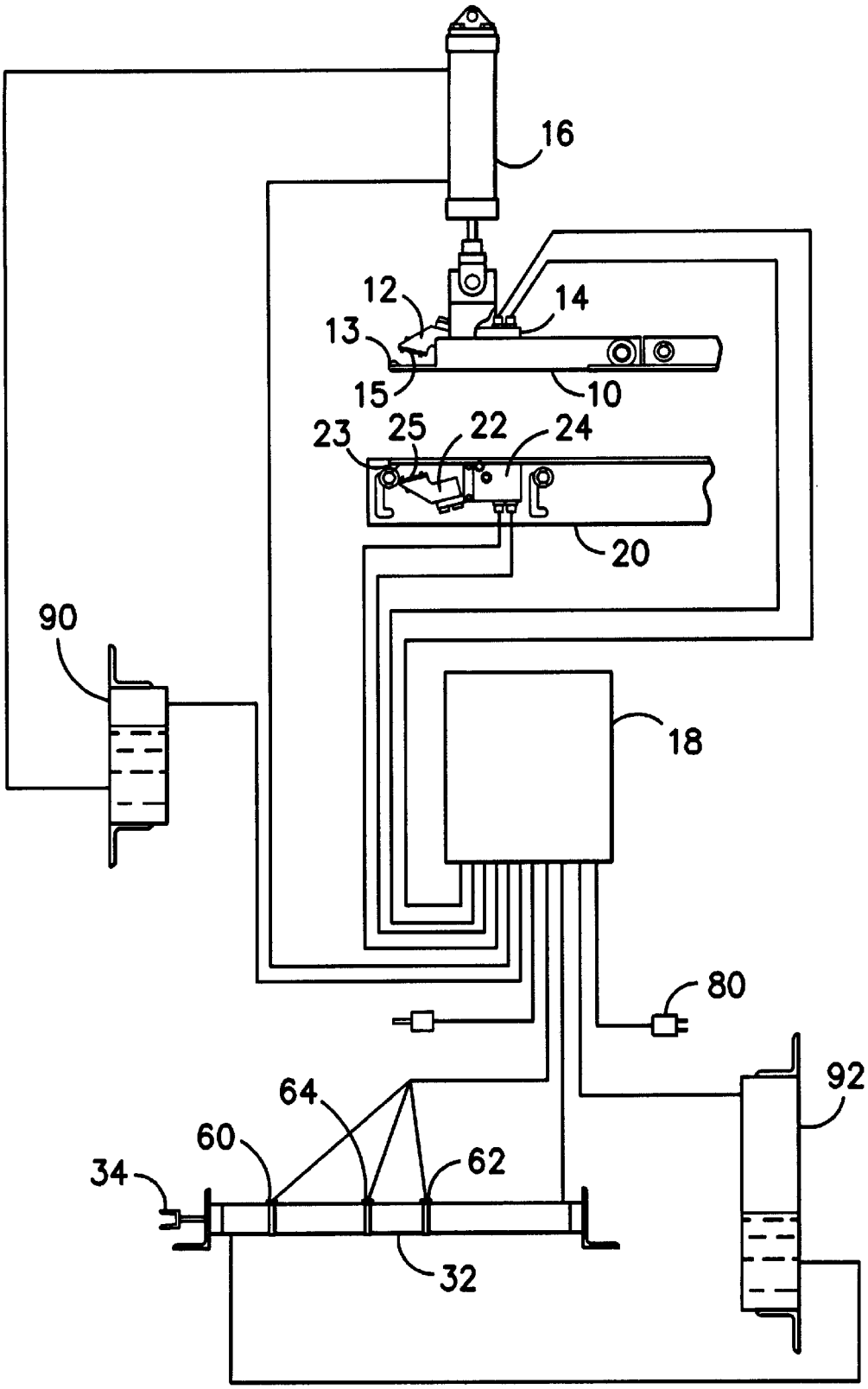
FIG. 10 is a schematic diagram of the fluid handling system of the device of FIG. 1.

FIG. 10 shows the fluid handling system of device 1, indicating the flow of air through a plurality of pneumatically-actuated cylinders (namely, clamp cylinders 14, 24) and the flow of air and oil through a plurality of pneumatically- and hydraulically-actuated cylinders (namely, stretch cylinder 16 and push cylinder 32). Electricity is supplied via electrical line 80. Located centrally in FIG. 10 is a representation of control panel 18, as described above.

Clamp cylinders 14, 24 are pneumatic cylinders. Push cylinder 32 and stretch cylinder 16 are each an air-over-oil cylinder. Push cylinder 32 is supplied by oil reservoir 92 (as shown in FIG. 10). The oil is delivered from the bottom of reservoir 92 to the rod end of cylinder 32 by compressed air applied to the surface of the oil, such that if there were a sudden release of energy during the pressurized extend stroke, then rod 33 would continue extending at a controlled, slow rate. A sudden release of energy on the extend stroke of push cylinder 32 could occur if hoop 42 is prematurely released from, or rips from, one or both of stretch arms 10, 20. Stretch cylinder 16 is supplied by oil reservoir 90 (also shown in FIG. 10). The oil is delivered from bottom of reservoir 90 to the retract end of cylinder 16 by compressed air applied to the surface of the oil, such that if there were a sudden release of energy during the pressurized retract stroke, then rod 15 would continue retracting at a controlled, slow rate. A sudden release of energy on the retract stroke of stretch cylinder 16 could occur if hoop 42 were to suddenly rip during the over-stretching process. The air-over-oil systems are provided as safety features to prevent accidents.

As an alternative to an air-over-oil cylinder, push cylinder 32 and stretch cylinder 16 could be pneumatic cylinders or hydraulic cylinders. In addition, push cylinder 32 and stretch cylinder 16 could be replaced by a lead screw and electric motor, by a linkage mechanism (such as a crank and piston), by a rack and pinion mechanism, by a series of manual ratchets, levers, or other linkages, or by any other conventional powered or manual means. Clamp cylinders 14, 24 could also be replaced with these alternative mechanisms, as well as air-over-oil cylinders.

Other alternative embodiments include replacement of fixed stretch arm 20 with a second movable stretch arm and replacement of the pivoting motion of stretch arm 10 with a linear motion. Another alternative would be to attach the seat bottom and seat back simultaneously. This would require a second pair of stretch arms positioned perpendicularly to base 4 and would require that both pair of stretch arms be moved toward bar 41 with frame 40 being held stationary. Alternatively, the motion of clamp cylinders 14, 24 could be modified from a pivoting motion to a linear motion.

Another contemplated alternative involves pulling fabric hoop 42 over a stationary frame 40, rather than pushing frame 40 into fabric hoop 42. This embodiment is less preferred, however, because of the need for additional guide structures that would be necessary to place stretch arms 10, 20 and stretch cylinder 16 into controlled motion.

Although the preferred embodiment of the invention has been specifically described, it is contemplated that many changes may be made without departing from the scope or spirit of the invention, and it is desired that the invention be limited only by the claims.

I claim:

1. A device for fitting a hoop of elastomeric fabric to a frame, said device comprising:

(a) a base having an upper side and an underside, and a guide that is associated with the upper side;

(b) a stretching mechanism attached to the upper side of said base, said stretching mechanism comprising at least one stretching means and a pair of opposed stretch arms, at least one of said stretch arms being a movable stretch arm, said movable stretch arm being operably associated with said stretching means;

(c) a pair of clamping means for clamping a portion of said hoop of elastomeric fabric to said pair of stretch arms, said clamping means being located at the respective ends of each of said stretch arms in the area in contact with said hoop, said clamping means having a pin plate being capable of securing the clamped portion of said hoop; and (d) a pushing mechanism comprising a pushing means, a frame carrier attached to said pushing means, and up to three reed switches operably associated with said pushing means, said reed switch or switches being capable of sensing the location of said pushing means.

2. The elastomeric hoop attachment device of claim 1 wherein said guide is the upper side of said base.

3. The elastomeric hoop attachment device of claim 1 wherein said guide is attached to the upper side of said base.

4. The elastomeric hoop attachment device of claim 1 wherein said stretch arms comprise at least one raised bulge in the contact area of said hoop to facilitate the securing of said hoop to said stretch arms.

5. The elastomeric hoop attachment device of claim 1 wherein said stretching means is selected from the group consisting of air-over-oil cylinders, pneumatic cylinders, hydraulic cylinders, lead screws and electric motors, cranks and pistons, racks and pinions, and combinations of ratchets, levers, or other powered or manual linkages.

6. The elastomeric hoop attachment device of claim 5 wherein said stretching means is an air-over-oil cylinder.

7. The elastomeric hoop attachment device of claim 1 wherein one of said stretch arms is movable and one of said stretch arms is fixed.

8. The elastomeric hoop attachment device of claim 7 wherein said movable stretch arm pivots around a pivot point that coincides within one end of said movable stretch arm.

9. The elastomeric hoop attachment device of claim 7 wherein said movable stretch arm moves in a substantially linear motion.

10. The elastomeric hoop attachment device of claim 1 wherein each of said stretch arms is movable and is operably associated with a stretching means.

11. The elastomeric hoop attachment device of claim 1 wherein said clamping means is selected from the group consisting of air-over-oil cylinders, pneumatic cylinders, hydraulic cylinders, lead screws and electric motors, cranks and pistons, racks and pinions, and combinations of ratchets, levers, and other powered or manual linkages.

12. The elastomeric hoop attachment device of claim 11 wherein said clamping means is a pneumatic cylinder, said clamping cylinder being operably associated with said pin plate, and said clamping cylinder having an incoming air pressure in the range of 1 to 250 pounds per square inch.

13. The elastomeric attachment device of claim 12 wherein the incoming air pressure utilized by said clamping cylinder is greater than 80 pounds per square inch.

14. The elastomeric attachment device of claim 1 wherein said plate has a plurality of angularly set pins.

15. The elastomeric attachment device of claim 14, wherein said clamping means moves said pin plates from an engaged position in which the pins of said pin plate penetrate and secure said hoop of elastomeric fabric, to a retracted position, in which the pins of said pin plates are pulled from said hoop of elastomeric fabric.

16. The elastomeric hoop attachment device of claim 1 wherein said pushing means is selected from the group consisting of air-over-oil cylinders, pneumatic cylinders, hydraulic cylinders, lead screws and electric motors, cranks and pistons, racks and pinions, and combinations of ratchets, levers, and other powered or manual linkages.

17. The elastomeric hoop attachment device of claim 16 wherein said pushing means is an air-over-oil cylinder.

18. The elastomeric hoop attachment device of claim 1 wherein said hoop is stretched by the movement of said stretch arms to between 1% and 30% of the relaxed width of said hoop.

19. The elastomeric hoop attachment device of claim 1 wherein said hoop, as attached to said frame, has a prestretch of between 1% and 20% of the relaxed width of said hoop.

20. The elastomeric hoop attachment device of claim 17 wherein said hoop, as attached to said frame, has a prestretch of between 3% and 7% of the relaxed width of said hoop.

* * * * *